United States Patent [19]

Stuart

[11] 3,985,311

[45] Oct. 12, 1976

[54] HAND OPERATED TAPING MACHINE FOR COILS

[75] Inventor: Donald J. Stuart, Park Ridge, Ill.

[73] Assignee: Midland Engineering and Machine Co., Rosemont, Ill.

[22] Filed: Dec. 28, 1973

[21] Appl. No.: 429,283

[52] U.S. Cl. ..... 242/7.08; 156/446

[51] Int. Cl. ..... H01f 41/12

[58] Field of Search ..... 242/7.08; 156/446, 185, 156/187

[56] References Cited

UNITED STATES PATENTS

| | | | |
|---|---|---|---|
| 2,220,256 | 11/1940 | Martindell | 242/7.08 |
| 2,542,303 | 2/1951 | Bosh et al. | 242/7.08 |
| 2,688,450 | 9/1954 | Bell | 242/7.08 |
| 3,253,794 | 5/1966 | Twigg | 242/7.08 |

*Primary Examiner*—Billy S. Taylor

*Attorney, Agent, or Firm*—Leydig, Voit, Osann, Mayer & Holt, Ltd.

[57] ABSTRACT

A hand operated taping machine for winding protective tape upon a wire coil used in a relay, solenoid or the like in which a coil is chucked upon a spindle. Tape with a tacky adhesive is fed via a series of rollers terminating in a leading end which is supported upon an applicator pad adjacent the coil. The pad is manually pressed into engagement with the coil to tack the leading end. The spindle is rotated via a main drive shaft by a manual crank. A cutter blade is provided adjacent the pad. A first cam on the main drive shaft lowers the cutter blade and pad permitting the tape, under tension, to be manually severed below the level of the coil to form a tail and to position a new leading end on the pad. A second cam on the main drive shaft operates a wiper to wipe the tail down upon the coil, withdrawing the wiper as the pad is restored to its initial tape applying position in readiness for a new cycle. Means are provided for creating slack in the run of tape incident to this return movement to insure that when the new leading end is tacked to a subsequent coil the coil will be able to rotate sufficiently to create purchase, so that the tape will not pull free of the coil, before normal winding tension is reestablished. A gear shift between the main drive shaft and the spindle determines the number of layers of tape which are applied in a single revolution of the main drive shaft.

15 Claims, 16 Drawing Figures

(ADHESION)

(MAIN DRIVE SHAFT 90°)

(MAIN DRIVE SHAFT 180°)

(MAIN DRIVE SHAFT 270°)

HAND OPERATED TAPING MACHINE FOR COILS

Sophisticated machines have been developed for applying a protective wrap of tape upon a coil for a relay or solenoid on a high production basis. However, such machines are expensive and relatively difficult to adapt to changes in coil size, tape width, type of tape, number of wraps or layers of tape, etc., and their usage is not practical for limited runs of less than several hundred pieces.

It is, accordingly, an object of the present invention to provide a hand operated taping machine which may be constructed at low cost but which is nevertheless highly efficient, capable of turning out limited production runs at low per unit cost and capable of prompt and easy conversion to coils and tapes of different sizes applied in a different number of layers.

In spite of its versatility, the machine is easily adjusted and operated to produce professional results even where the operator has not had prior training or experience.

Other objects and advantages of the invention will become apparent upon reading the attached detailed description and upon reference to the drawings in which.

Figure 2:
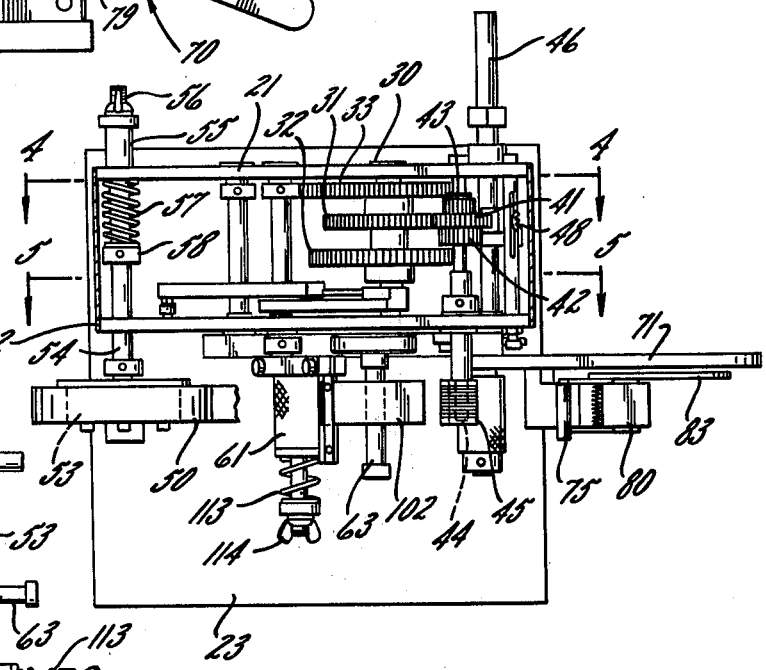
FIG. 2 is a top view of the machine shown in FIG. 1.
Figure 3:
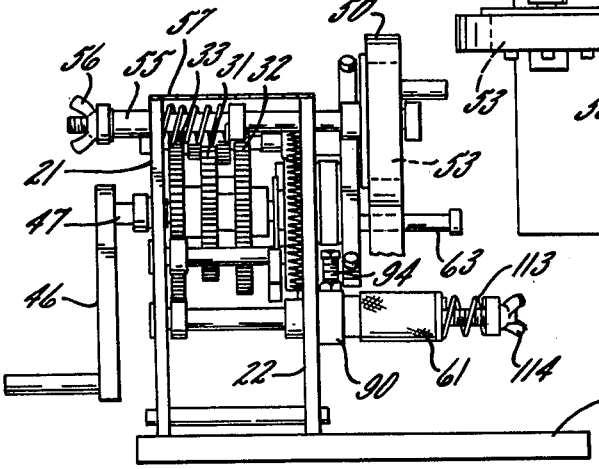
FIG. 3 is an end elevation of the machine of FIGS. 1 and 2.
Figure 4:
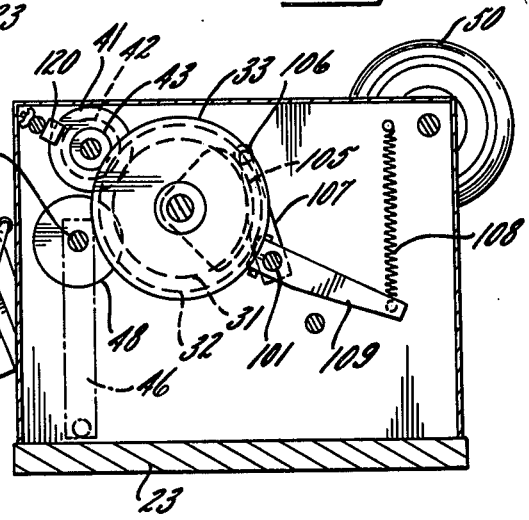
Figure 5:
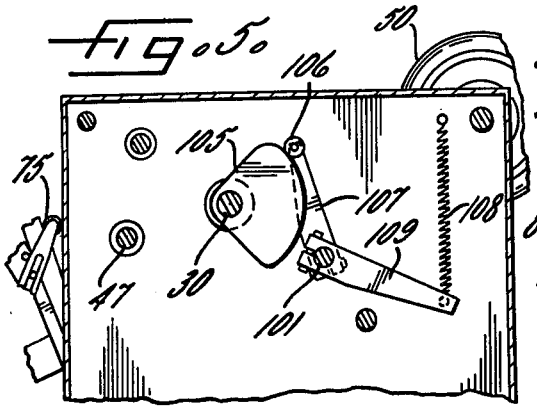

FIGS. 4 and 5 are vertical sections taken along the lines 4—4 and 5—5 in FIG. 2, respectively.

Figure 1:
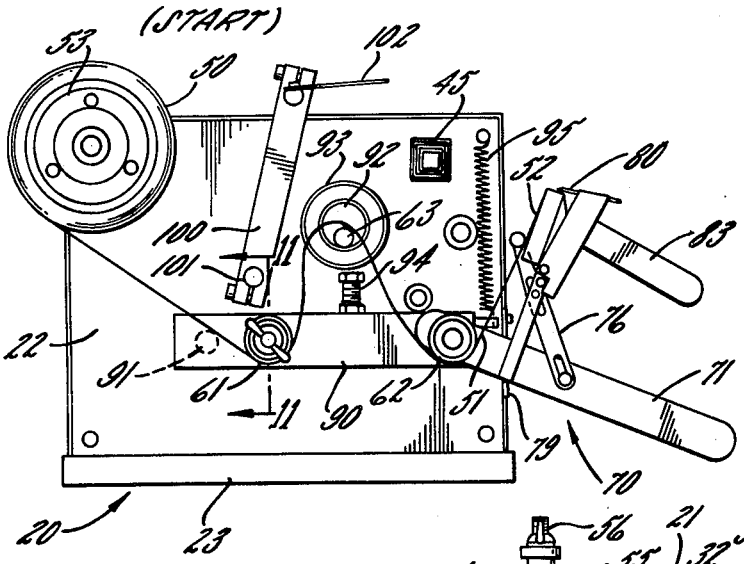
FIG. 1 is a side elevation of a machine constructed in accordance with the present invention.
Figure 6:
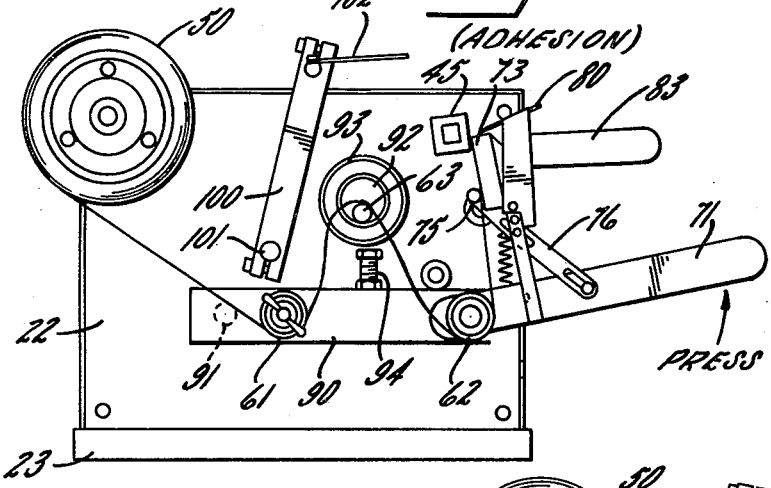

FIG. 6 is an elevational view similar to FIG. 1 but showing tacking of the tape to the coil winding.

Figure 7:
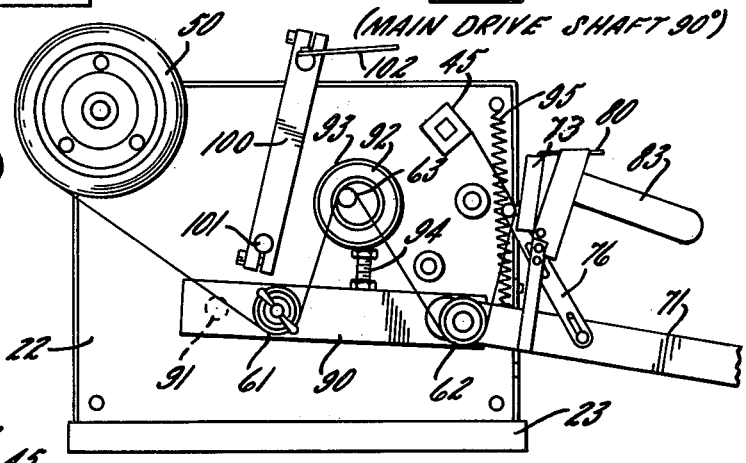

FIG. 7 is a stop motion view similar to FIG. 6 but showing the postion of the parts after rotation of the main drive shaft through an angle of 90°.

Figure 8:
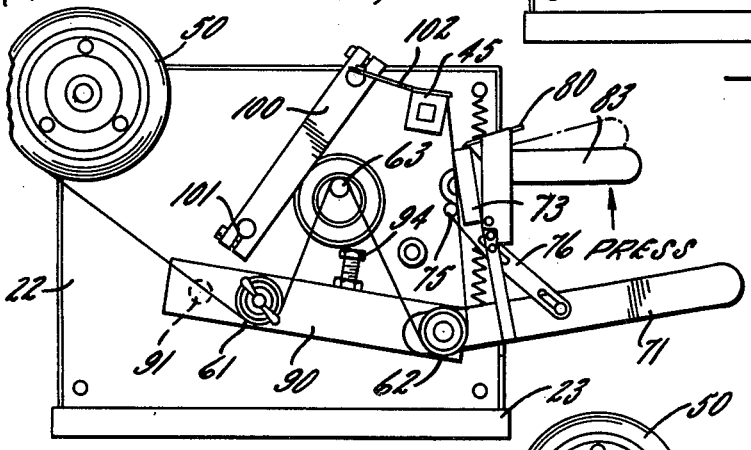
Figure 8A:
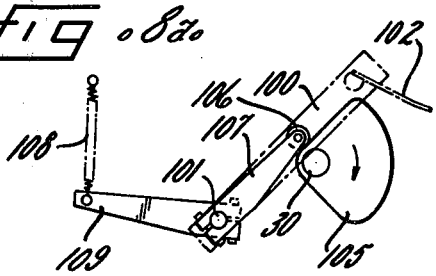

FIG. 8 is a further stop motion view at main drive shaft rotation of 180° and with the tape about to be severed.

Figure 9:
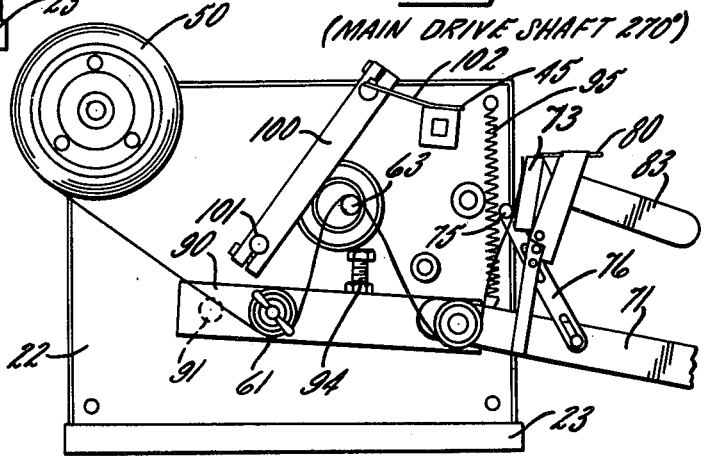
Figure 9A:
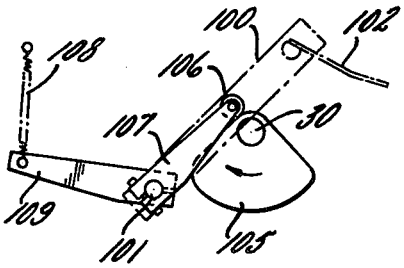

FIG. 9 is a stop motion view at 270° of rotation and following severence of the tape.

FIGS. *6a–9a* are fragments showing the respective positions of the wiper cam.

Figure 10:
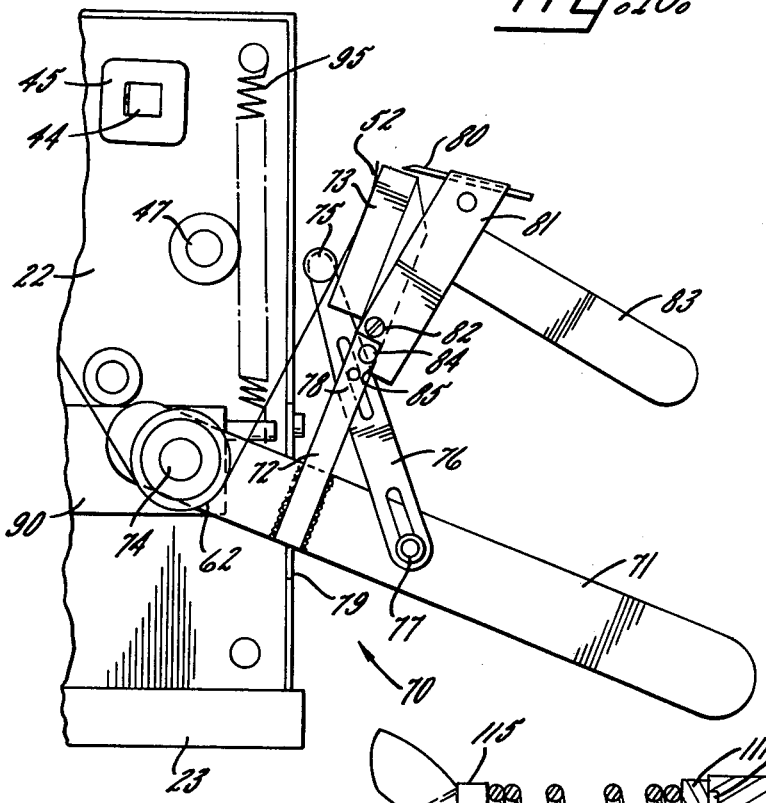

FIG. 10 is an enlarged view of the pad arm and cutter blade mount.

Figure 11:
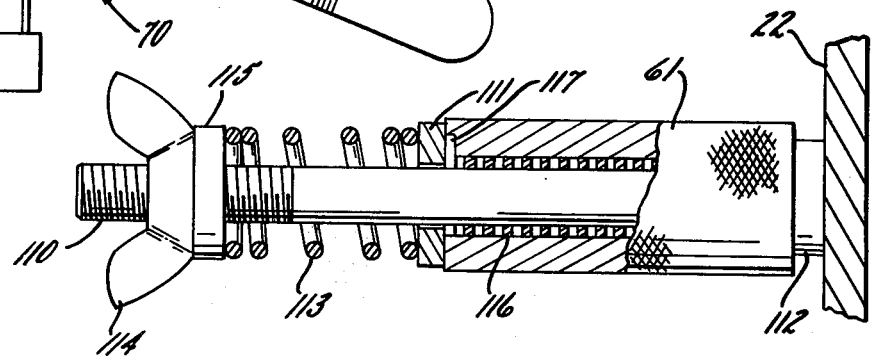

FIG. 11 shows a section taken through one of the non-retrograde rollers.

Figure 12:
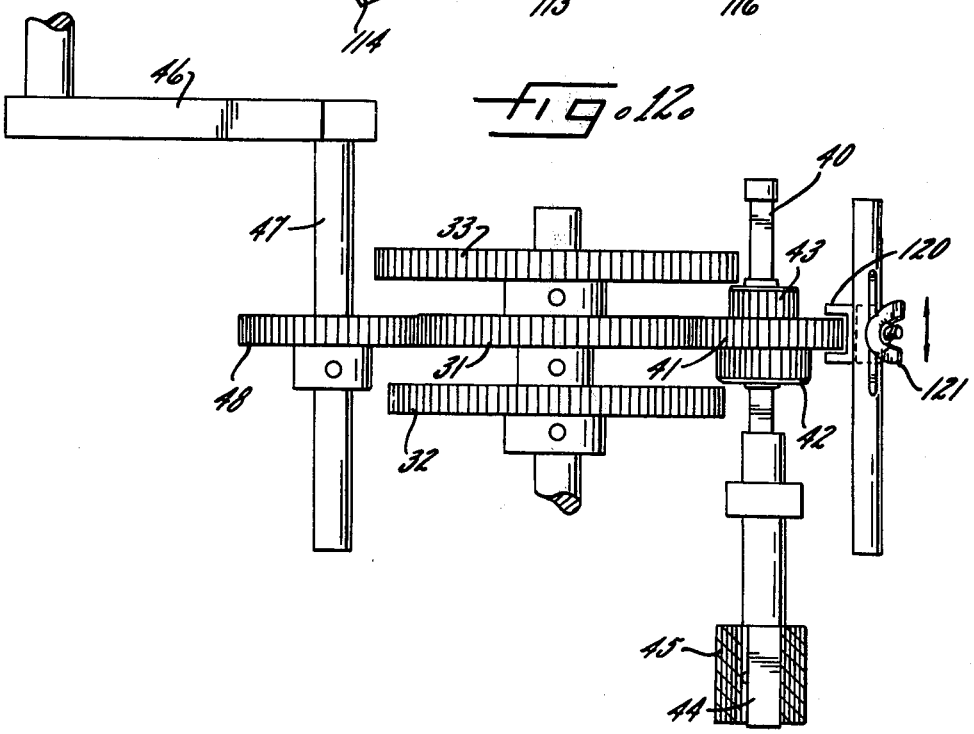

FIG. 12 is a developed view showing the gear shifting arrangement used to select the number of turns of tape in each operating cycle.

While the invention has been described in connection with a preferred embodiment, it will be understood that it is not intended to be limited to the particular embodiment but it is intended, on the contrary, to cover the various alternative and equivalent constructions included within the spirit and scope of the appended claims.

Turning now to the drawings there is shown a hand taping machine 20 having a frame consisting of a pair of spaced apart plates 21, 22 mounted upon a base 23. Journaled in the frame is a main drive shaft 30 having a main drive gear 31 and auxiliary gears 32, 33 for a purpose which will shortly appear. Also journaled in the frame is a spindle 40 having a main driven pionion 41 and corresponding auxiliary pinions 42, 43. At the end of the spindle is a chuck 44 (see also FIG. 12)

which carries a coil 45 wound with relatively fragile magnet wire and of the rectangular configuration usually employed in solenoids and relays, the coil in the usual case being wound upon a bobbin having side flanges. For rotating the main drive shaft and spindle, a manual crank 46 is provided having a crank shaft 47 and drive pinion 48 which meshes with the main drive gear 31. Assuming the gears are set as illustrated in the drawings and using a gear-pinion ratio of 2:1, the spindle rotates in unison with the manual crank, and two revolutions of the crank are required to bring about a single revolution of the main drive shaft.

For supplying tape to the coil a spool of tape indicated at 50 having a final run 51 and leading end 52 is mounted upon a mandrel 53. The mandrel has a shaft 54 which is mounted, as shown, between the frame plates. The shaft is made axially adjustable by providing a spacer or bushing 55 secured by and adjustable wind nut 56. The latter works against a spring 57, the end of which is positioned against a flange 58. The tape is guided in its passage from the spool to the coil by passing it around rollers 61, 62, 63, to which reference will later be made.

For tacking the leading end 52 of the tape against the side of the coil 45, the tape is supported upon a resilient pad which is secured upon a pivoted pad arm which may be manually rocked. Thus, referring to FIG. 10, the pad arm 70 has a horizontal portion 71 which serves as a handle and a vertical portion 72 which is welded or otherwise secured to it. Mounted at the upper end of the arm is a resilient pad 73 which, as shown, occupies an initial position adjacent to, and alined with the coil, with the arm being pivoted upon an axis 74 to bring the pad into engagement with the coil. For maintaining the leading end of the tape in proper position, face out, on the pad, a "keeper" 75, extends crossways just in front of the pad near its lower end, with the keeper being in contact with the tacky side of the tape. Since very little force is necessary to keep the tape in place, the keeper is preferably in the form of a deeply knurled cylinder providing a two-dimensional pattern of points of contact. The keeper is mounted upon an adjustable bracket 76 which is secured to the horizontal portion 71 of the arm by a clamping screw 77. The bracket is slotted, as shown, and may be held in place at its upper end by a registering pin 78. A stop 79 on the frame not only limits rearward swing of the pad arm but brings about a forward swing as will be discussed.

In accordance with the invention a manually operated cutter blade is provided at the top of the applicator pad, with the pad arm having provision for movement vertically from an upper, tape-applying position to a lowered position in which the cutter blade is spaced well below the coil for severing of the tape, the vertical movement being cyclical and in accordance with the phase of the main drive shaft.

Referring first to the cutter blade as shown in FIG. 10, it will be noted that the cutter blade 80 is arranged generally horizontally and closely adjacent the upper end of the applicator pad 73. The blade is secured to the upper end of a pivoted blade arm 81 which is pinned, at its lower end, by a screw 82 to the side of the pad arm 72. For rocking the blade, the arm 81 has a handle 83. The retracted position of the blade is determined by a stop pin 84 in the arm 72 which is in the path of movement of a stop surface 85.

For the purpose of lowering the pad arm 70 so that the cutter blade 80 is positioned below the coil, the pad arm is mounted at the remote end of a horizontally extending main arm 90 which is pivoted to the frame at a pivot 91. The position of the main arm 90 is determined by a cam which is mounted at the forward end of the main drive shaft 30, the cam being surrounded by an anti-friction race 93. For engaging the cam race, and serving as a cam follower, a machine screw 94 is mounted in the upper surface of the arm. At the initial portion of the taping cycle the cam lobe 92 extends upwardly so that the main arm occupies its horizontal, that is, uppermost, position. A tension spring 95 biases the follower 94 upwardly into bottoming contact with the cam race.

Further in accordance with the invention a wiper is provided for "wiping down" the severed tail end of the tape, the wiper occupying a normally retracted position but movable into wiping position under the influence of a cam on the main drive shaft.

Thus referring to FIGS. 1 and 5 a wiper arm 100 is provided pivoted on a shaft 101 which is journaled in the frame and carrying at its remote end a wiper 102 in the form of a blade of nylon or the like having a width which is substantially equal to the tape width and which in any event is narrow enough to be accepted between the bobbin end flanges which may form a part of the coil assembly. Moreover, the wiper may be longitudinally slit to form a plurality of individual flexing fingers.

To oscillate the wiper arm a cam 105 of quadrant shape is provided upon the main drive shaft 30 (see FIG. 5) for riding upon the surface of the cam follower 106 is secured to a follower arm 107 which is in turn clamped to the wiper arm shaft 101. The follower is biased into engagement with the cam by a biasing spring 108 secured to the end of a biasing spring arm 109. The cam 105 is so phased that the wiper is held in an out-of-the-way position during the time that the coil is being installed and during the initial rotation thereof. However, as the tape is severed the wiper descends to wipe the tail against the coil, following which the wiper is rocked back to retracted position.

It is one of the further features of the present invention that non-retrograde action is incorporated within the guiding rollers so that, even though the tape is cut under tension, any springback of the tape is minimized insuring that the leading end of the tape will be maintained in a position adjacent the upper end of the applicator pad. Thus in the present construction both of the rollers 61, 62 are of the non-retrograde type, the roller 61 including, in addition, a braking function as illustrated in FIG. 11. The roller 61 is rotationally mounted on a shaft 110 which is secured at its base end to the frame. At the ends of the roller are annular collars 111, 112. For applying endwise pressure to the collar 111 a coil spring 113 is used which is compressed by a wing nut 114 having an adjacent washer 115. The wing nut adjusts the spring which controls the braking force.

In order to obtain the non-retrograde feature, the roller 61 has a central coil spring 116 which is connected at one of its ends 117 to the roller. The direction of the spring is such that normal forward movement of the roller tends to unwind the spring which then slips upon the shaft, but any tendency for the roller to rotate in the opposite direction, due to springback of the tensioned tape, is blocked by seizure of the spring. The same non-retrograde construction is incorporated in the roller 62.

It is one of the features of the present invention that intentional slack is provided in the run of tape as a result of downward and upward cycling of the main arm 90. This slack is brought about by mounting the non-retrograde rollers 61, 62 on the movable main arm 90 and by mounting the idler roller 63 above them in a fixed position on the frame. Preferably the idler roller 63 is concentric with the main drive shaft 30. It will be apparent that as the main arm 90 is swung downwardly about its pivot 91 the loop of tape between the non-retrograde rollers 91, 92 is elongated, with the incremental amount of tape being drawn from the spool, accompanied by slight forward rotation of the roller 61. Then, subsequently, as the main arm 90 rocks upwardly, slack is produced in the loop so that when the leading end of the tape is tacked to the coil and the latter is rotated there is no initial force tending to pull the leading end free of the coil.

This feature, and the other features of the present invention will become more apparent upon considering a typical operating sequence. Such sequence is shown starting with FIG. 1 and in the stop motion views FIGS. 6–9 inclusive.

The mechanism initially occupies the condition shown in FIG. 1. The spool of tape 50 is in place, with the leading end thereof resting against the pad 73, and with the tape slightly slack. The manual crank is in its lowermost position. The main arm 90 is held in its uppermost position by the cam 92, and the wiper arm 100 is held in retracted position by cam 105.

Figure 6A:
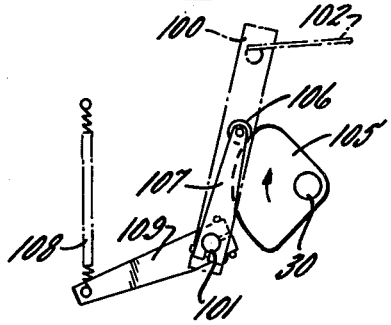

As a first step the operation (FIG. 6) applies upward rocking pressure to the arm 71 which brings the pad 73, carrying the leading end of the tape, against the coil 45, so that the leading end is adhesively tacked to the coil. The manual crank 46 is then rotated, causing rotation of the coil. Because of the slight amount of slack in the tape due to the previous cycling of the machine, the leading end of the tape achieves good purchase upon the coil before tension is developed in the tape. At this time the cam 105 which operates the wiper arm is phased as shown in FIG. 6*a*, with the wiper arm fully retracted.

Figure 7A:
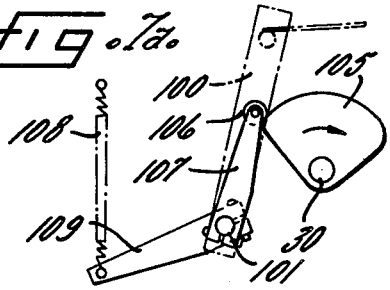

After a half revolution of the manual crank, that is, after the main drive shaft 30 rotates through an angle of 90°, the mechanism appears as shown in FIGS. 7 and 7*a*. That is, the main arm 90 will have begun its downward movement under the influence of cam 92 and the tape will have been wound approximately halfway around the coil.

Completing a full revolution of the crank the main drive shaft 30 rotates through a total angle of 180° as shown in FIG. 8. At this point the coil has undergone a full revolution and the main arm 90 has been crowded downwardly by the cam 92 until the pad arm, and the blade which is mounted upon it, occupy their lowermost position. Engagement of the stop 79 by the pad arm has caused the arm to be rocked forwardly. Moreover, drop-off has occurred at cam 105 so that the wiper, having been released, is resiliently pressed against the coil by the wiper spring 108. The operator is instructed, upon completion of the first revolution of the crank 46, to operate the cutter arm 83 by pressing it upwardly into the dotdash position shown in FIG. 8. This advances the cutter blade forwardly along the upper edge of the applicator pad and into contact with the tensioned tape. Because of the favorable location of the pad very little movement of the cutter arm is required to sever the tape. Severance leaves a loose tail and creates a new leading end which is securely held in place on the pad by the keeper 75.

Rotation of the crank through another half revolution, resulting in total angular movement of 270° at the main drive shaft, places the parts in the condition shown in FIG. 9. The tail end of the tape has been wiped into position but the wiper has not yet been retracted. The main arm 90 has, in this figure, begun to rock upwardly. Finally, completing the second full rotation of the crank restores the parts to the condition shown in FIG. 1 in which the main arm 90 is fully restored to its upper (horizontal) position and in which the wiper arm 100 is fully retracted. The pad arm 70, free of any manual guidance is also fully retracted resting against the fixed stop 79. This leaves the "field" open for removal of the taped coil 45 and for substitution of a new coil so that a new cycle can begin.

By using a 1:2 ratio between gears 48, 31 and a 2:1 ratio between gears 31 and 41 on the coil spindle, the coil is caused to rotate at the same speed as the crank but half as fast as the main drive shaft. This results in a single layer of tape on the coil with generous amount of overlap and enables sufficient wiping at the end of the cycle to insure lay-down of the tail. The job is done efficiently and completely with just two turns of the crank and the operator is not tempted to give another turn "for good measure".

It is, however, one of the features of the present machine that the same number of turns of the crank may be utilized to apply two or even three layers of tape to the coil. This is accomplished by the gear shift mechanism which is interposed between the main drive shaft and the coil spindle. The pinion cluster 41, 42, 43 is splined to the spindle 40. To change the gear ratio a yoke 110 is provided which is clamped in place by a thumb nut 111 (see FIG. 12). To apply two layers of tape the cluster is slid in a direction to engage gear 33 with pinion 43. It is to be noted that it takes no more time on the part of the operator to apply three layers than it does one, and there is no need for the operator to relate the numbers of layers to the number of turns of the crank. Nor is it possible for an operator who may be on piecework to apply less than the specified number of wraps once the yoke 110 has been fixed in its proper position.

The present machine has been found ideally suited to special runs of up to several hundred coils of given type, achieving an economy which approaches that of the more expensive power driven machines. However, the versatility and convenience of the present unit greatly exceeds that of the more elaborate taping machines, permitting accommodation, in a matter of minutes, to coils and tapes of widely different dimension and design. Thus coils of different internal diameter may be mounted by by a simple switch of chuck 44. Tape of the appropriate width may be accurately centered by quick adjustment of the endwise position of the mandrel 53. Finally, it takes but a moment to change to a different width of wiper 102, and adjustment of tape tension is easily brought about by turning the brake adjusting nut 114.

As previously noted, the field is free for loading and unloading of a coil which is retained with light friction on the chuck. If desired, it will be apparent to one skilled in the art that a suitable ejector may be used, for example, in the form of a simple arm pivoted to the frame and positioned, upon application of pressure to a threadle or the like, to nudge a taped coil endwise from the chuck.

It will also be apparent to one skilled in the art that minor departures may be made from the disclosed construction without in any way departing from the invention. For example, what is termed the idler roller 63 need not be a roller and may be simply a polished shaft, or cylinder, freely engaging the backside of the tape. While a manually turned crank is used for powering the device, it will be apparent that the main drive shaft may be turned by any manual or, if desired, foot operated means to achieve a single cycle of rotation of the main drive shaft, and thus it is intended that the term "crank" receive a reasonably broad interpretation. Moreover, while the member which supports the applicator pad has been referred to as an "arm", it will be apparent that in the broader aspects of the invention it is not essential that the pad be pivotally mounted. It could, for example, perform its function with straight line movement if desired, provided that it, and the associated cutter blade, are cycled vertically in unison with one another as discussed. While the device has been described with reference to the illustrated "vertical" orientation, it will be understood that the device may be operated in other orientations and that the recited directions are relative. Finally, it will be understood by one skilled in the art that the utility of the machine goes beyond the protection of coils and that the machine may be profitably employed wherever an element of similar shape is to be protected. Consequently, the term "coil" as used herein is employed in a generic sense.

Machines of the present design have not only been found to be easy to use, with little skill required on the part of the operator, but have been found to be economical to construct using easily available or readily machined components.

What is claimed is:

1. In a hand operated taping machine for winding protective tape upon a wire coil, the combination comprising a frame, a spindle journaled in the frame having a chuck at the end thereof for gripping a coil, drive means including a crank for rotating the spindle, a spool of adhesive tape providing a leading end, a vertical pad arm having a pad occupying an initial tape-applying position opposite the coil for supporting the leading end of the tape, means defining a run of tape between the spool and the pad on the pad arm, means for mounting the pad arm for manual movement toward and away from the coil for enabling the pad to be pressed against the coil to tack the leading end of the tape to the coil, means associated with the spool for braking the run of tape so that as the crank is turned the tape is wound on the coil under tension, a cutter blade adjacent the upper end of the pad and manually movable from a retracted position to an extending cutting position, means including a drive connection connected between the pad arm and the crank for (*a*) bodily lowering the pad arm as the crank is turned so that the cutter blade is positioned below the coil and opposite the tensioned run of tape so that when the cutter is manually moved the tape is severed to form a tail end and a new free end and for (*b*) raising the pad arm back to its initial position opposite the coil, anti-retrograde means associated with the pad for insuring that the free end upon being severed remains on the pad in readiness for tacking to a new coil, and means operated by the crank for elongating the run of tape during the lowering of the pad arm and for shortening the run during the raising of the pad arm so as to create a small amount of slack in the run so that when the leading end of the tape is tacked to a new coil it is free of any tendency to pull off during the initial rotation of the coil.

2. The combination as claimed in claim 1 in which the means for lowering and raising the pad arm includes a cam cyclically rotated by the crank and a cam follower coupled to the pad arm.

3. The combination as claimed in claim 1 in which a horizontal arm is provided having means for mounting it on the frame for upward and downward movement and having a pivot connection with the lower end of the pad arm for mounting the latter, and a stop in the path of downward movement of the pad arm and laterally spaced from the pivot connection so that the pad arm swings about its pivot toward the tape to position the cutter blade in a favorable cutting position.

4. The combination as claimed in claim 1 in which the pad has an associated keeper mounted on the pad arm and spaced forwardly of the pad to maintain the tape, following severance, in contact with the pad.

5. The combination as claimed in claim 1 in which the braking means is in the form of a frictionally braked non-retrograde roller on the pad arm.

6. The combination as claimed in claim 1 in which rollers including a bodily movable roller are provided in spaced positions with respect to the frame to form the run of tape into a loop and in which the elongating means includes means for coupling the movable roller to the crank for bodily movement thereby, the coupling means being so phased that the loop is elongated incident to the lowering of the pad arm and shortened incident to raising of the pad arm to create slight slack in the run of the tape so that when the leading end is tacked to the coil by the pad, the leading end is free of substantial tension until the coil has been rotated through a sufficient angle to provide good purchase thereby to prevent the leading end from pulling free of the coil during its initial rotation.

7. The combination as claimed in claim 1 in which the anti-retrograde means is in the form of a final roller mounted for bodily movement at the lower end of the pad arm and a relatively stationary idler roller mounted on the frame above the final roller for feeding tape to the latter so that the tape is formed into an inverted U-shaped loop for creating slack in the tape as a result of the bodily movement of the final roller relative to the idler roller.

8. The combination as claimed in claim 1 in which the means for lowering and raising the pad arm is in the form of a generally horizontally extending main arm pivoted to the frame at one end and mounting the pad arm at the other end, the non-retrograde means including a pair of non-retrograde rollers horizontally spaced from one another on the main arm and an idler roller mounted on the frame above the non-retrograde rollers to define a loop of tape of inverted U-shape in which slack is created as the main arm is restored from its lowered position to its initial tape-applying position.

9. In a hand operated taping machine for winding a protective length of tape upon a wire coil, the combination comprising a frame, a spindle journaled in the frame and having a chuck at the end thereof for gripping a coil, drive means including a crank and drive shaft for rotating the spindle, a spool of adhesive tape mounted on the frame and providing a leading end, a main arm on the frame pivoted adjacent the spool extending horizontally and having a vertically swingable remote end, a vertically extending pad arm pivoted to the remote end of the main arm and having a pad for supporting the leading end of the tape, the pad occupying an initial tape-applying position opposite the coil, the pad arm having manual means for rocking the same for causing the upper end of the pad to press against the coil to tack the leading end of the tape to the coil, roller means for conducting a run of tape from the spool to the pad, said roller means for including a non-retrograde final roller at the end of the main arm and an idler roller on the frame above the final roller, means including a brake for tensioning the run of tape so that as the handle is turned the tape is wound on the coil under tension, a cutter blade adjacent the end of the pad and manually movable from a retracted position to an extended cutting position, a cam on the drive shaft and engaging the horizontal arm for cyclically (*a*) lowering the pad arm as the handle is turned so that the cutter blade is positioned below the level of the coil and opposite the tensioned run of tape for manual severing of the tape to form a tail end and a new free end which remains on the pad and (*b*) raising the pad arm back to its initial position, a wiper mounted for swinging movement between an active position in which the wiper presses the tail end of the tape onto the coil and a retracted position, and a cam on the drive shaft for oscillating the wiper so that the wiper is retracted free of the coil as the pad arm is raised to its initial tape-applying position in readiness for taping a new coil.

10. The combination as claimed in claim 9 in which a gear shift mechanism is interposed between the spindle and the drive shaft thereby to vary the number of turns of tape applied to the coil during a cycle of movement of the crank.

11. In a hand operated taping machine for winding protective tape upon a wire coil the combination comprising a frame, a spindle journaled in the frame and having a chuck at the end thereof for gripping a coil, a main drive shaft having a crank for rotating the same, a spool of adhesive tape providing a leading end, a pad arm having a pad for supporting the leading end of the tape in an initial tape-applying position opposite the coil, means for mounting the pad arm for movement toward and away from the coil, the pad arm being manually movable for causing the pad to press against the coil to tack the leading edge of the tape to the coil, brake means for tensioning the tape between the spool and the leading end so that as the crank is turned the tape is wound on the coil under tension, a cutter blade adjacent the end of the pad and manually movable from a retracted position to an extended cutting position, means including a first cam on the drive shaft for (*a*) bodily lowering the pad arm as the crank is turned so that the cutter blade is positioned below the level of the coil and opposite the tensioned run of the tape so that when the cutter is manually moved the tape is severed to form a tail end and a new free end which remains on the pad and for (*b*) raising the pad arm back to its initial position, a wiper mounted for movement toward and away from the coil, and a second cam on the drive shaft for oscillating the wiper so that as the crank is turned the wiper presses the tail end of the tape onto the coil followed by retraction of the wiper as the pad arm is raised to its initial tape-applying position in readiness for taping a new coil.

12. The combination as claimed in claim 11 in which a gear shift mechanism is interposed between the main drive shaft and the spindle permitting a predetermined number of turns of tape to be applied to the coil during a single cycle of rotation of the drive shaft.

13. The combination as claimed in claim 11 in which the drive shaft has a main gear, in which a drive pinion is provided on the crank for engaging the main gear and in which a driven pinion is provided on the spindle for rotating the latter, the drive pinion being one-half the diameter of the main gear so that a taping cycle requires two turns of the crank with the cutter being operated upon completion of the first turn.

14. The combination as claimed in claim 11 in which a set of main gears of different diameter are provided on the drive shaft in which a drive pinion is provided on the crank for meshing with one of the gears on the drive shaft, and in which the spindle is provided with a slidable cluster of pinions for driving of the spindle by a selected one of the main gears thereby to determine the number of layers of tape which are applied to the coil during a single cycle of movement of the main drive shaft.

15. The invention as claimed in claim 1 in which a wiper is arranged opposite the coil, means for mounting the wiper on the frame for movement toward and away from the coil, and means for coupling the wiper to the crank so phased that as the crank is turned the wiper is advanced to press the tail end of the tape onto the coil followed by subsequent movement of the wiper clear of the coil as the pad arm is raised to its initial tape-applying position in readiness for taping a new coil.

* * * * *